United States Patent [19]

Lichtenberg

[11] Patent Number: 4,862,561

[45] Date of Patent: Sep. 5, 1989

[54] IRREVERSIBLE TIE STRAP WITH SPECIALIZED CLASP

[75] Inventor: Jose Lichtenberg, Mexico City, Mexico

[73] Assignee: Designs by Master Markets, Inc., Sherman Oaks, Calif.

[21] Appl. No.: 288,419

[22] Filed: Dec. 21, 1988

[51] Int. Cl.[4] ..... B65D 63/00

[52] U.S. Cl. ..... 24/16 PB; 24/17 AP; 24/30.5 P

[58] Field of Search ..... 24/16 PB, 17 AP, 30.5 P, 24/20 EE; 292/311, 317, 318, 319, 320, 321, 322, 323; 248/74.3

[56] References Cited

U.S. PATENT DOCUMENTS

| | | | |
|---|---|---|---|
| 2,262,840 | 11/1941 | Gibson et al. . | |
| 3,292,961 | 12/1966 | Moberg . | |
| 3,744,096 | 7/1973 | Kok | 24/16 PB |
| 4,377,887 | 3/1983 | Valestin | 24/16 PB |
| 4,543,691 | 10/1985 | Calmettes | 24/20 EE |
| 4,574,434 | 3/1986 | Shupe et al. | 24/30.5 P |
| 4,665,588 | 5/1987 | Nakano | 24/16 PB |
| 4,680,834 | 7/1987 | Andre et al. | 24/16 PB |

FOREIGN PATENT DOCUMENTS 1471561 3/1967 France .

*Primary Examiner*—Victor N. Sakran
*Attorney, Agent, or Firm*—Thomas I. Rozsa

[57] ABSTRACT

An irreversible tie strap in which the tieing strap comes in a roll including an elongated strip member having a multiplicity of holes, grooves or slots therein to accommodate a mating tongue. The strap in roll form can be cut to any desired length, thereby facilitating an efficient strap which can be produced in a single mold and which can be cut to any desired length. Included in the irreversible tie strap is a separate clasp member which can be attached to one end of the tie strap in a novel manner by which it is permanently affixed and which further can accommodate any desired hole or opening in the strap through an internal tongue which permits the strap to pass through the clasp member until the desired length is achieved and then locked in place by the tongue and groove arrangement.

25 Claims, 3 Drawing Sheets

Fig. 1.
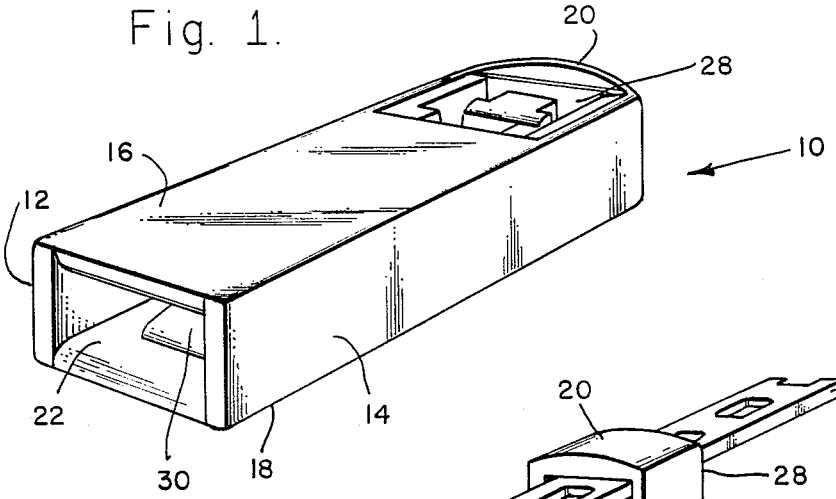
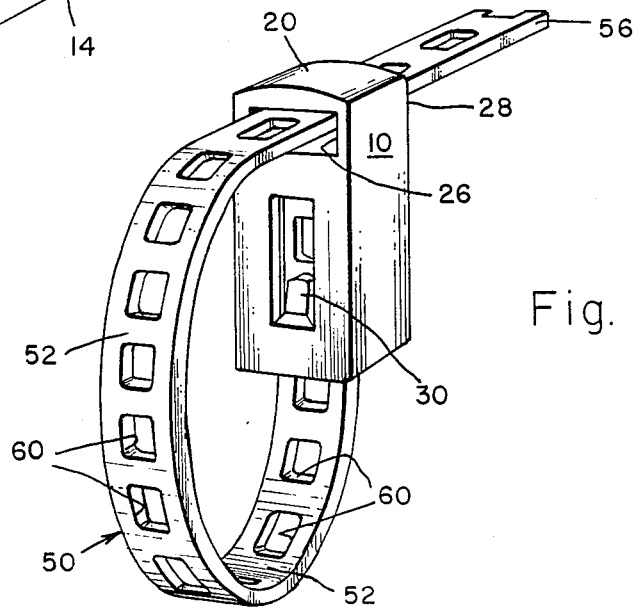
Fig. 2.
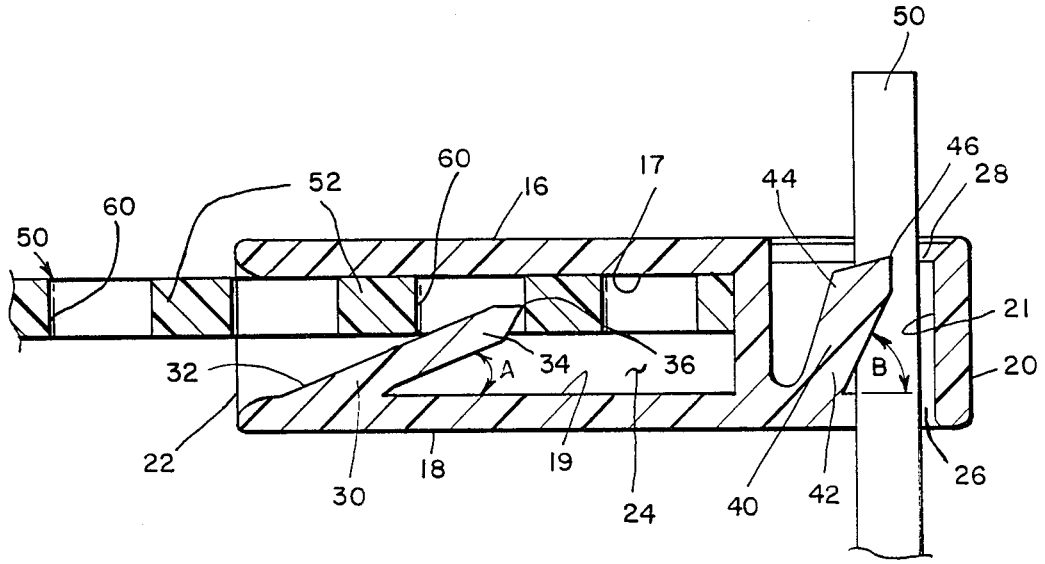
Fig. 3.

Fig. 4.
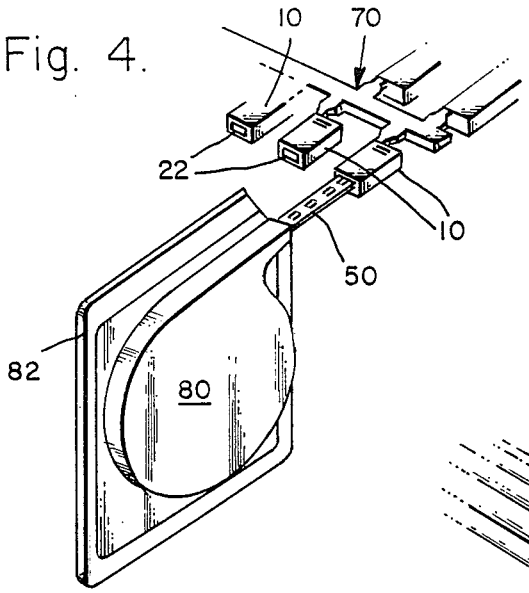
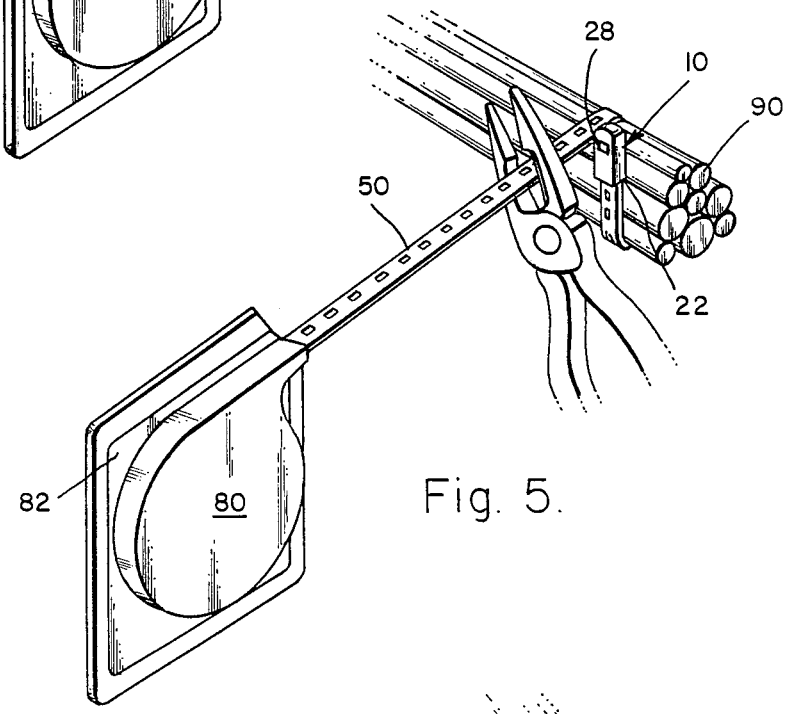
Fig. 5.
Fig. 6.
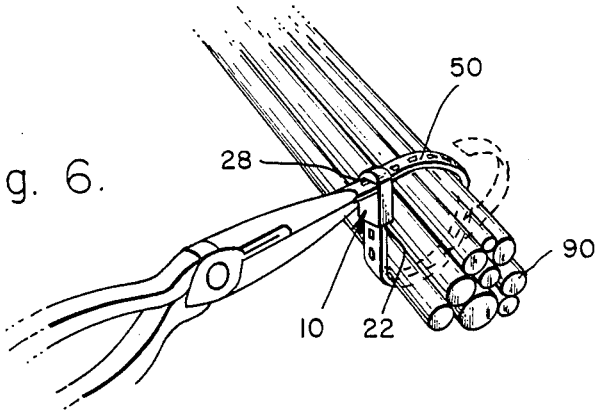

IRREVERSIBLE TIE STRAP WITH SPECIALIZED CLASP

BACKGROUND OF THE INVENTION

1. FIELD OF THE INVENTION

The present invention relates to apparatus such as fastening means which can tie up things such as cables, wires etc. in a manner by which the fastening means is locked in place to secure the objects together and such that the fastening means cannot be released without being permanently cut. The present invention further relates to the field of flexible ties which are produced in a continuous roll and can be adjusted to any multiplicity of desired lengths. The present invention also relates to the incorporation of a novel locking member to be used in conjunction with the continuous strip.

2. DESCRIPTION OF THE PRIOR ART

In general, flexible tie apparatus have been known in the prior art. One type of flexible tie known in the prior art involves the creation of a specific flexible strap with a clasp incorporated into the strap at one end. This type of tie is interjected into a whole component of clasp and strap and is made of thermoplastic materials. While this device serves a function similar to the present invention, a major problem with this prior art embodiment is that each different length requires a separate mold. Each strap can only be made to a specific desired length and therefore a separate mold must be made for each strap. Excessive lengths cannot be contrived. Therefore, only generally commercial lengths are produced and it is not possible for the consumer to have specialized lengths created. As a result, there is a lot of waste of material which is discarded when excessive lengths are used for smaller tie applications. In addition, from a manufacturing standpoint, it is necessary to have numerous different molds and manufacturing processes to produce the various sized ties.

A Japanese product involves the production of ties in automatic form. A continuous monofilament of plastic material is hurled around the object to be tied. The production process further involves the production of a special knot which thermofastens the monofilament and cuts the excess. This monofilament is a continuous strip of material and is not in the form of a tie with either projecting tongues or a multiplicity of holes to receive tongues.

Several prior art patents are also known which involve various types of tie arrangements.

1. U.S. Pat. No. 2,262,840 issued to Gibson et al in 1941 for "Car Sealing Device" discloses a sealing device made of metal where the flexible strap includes a multiplicity of tongues which are pulled through and locked in place inside an end sleeve. The concept is that the strap can be pulled as small as possible so that no one can easily cut the tie. The tongues on the strap also lock within the sleeve so as to make it irreversible. The locking means is integral with the strap and therefore only specific lengths are achieved with each mold produced.

2. U.S. Pat. No. 4,680,834 to Andre et al in 1987 for "Cable Tie" discloses a flexible plastic strap which can come in various lengths and in a roll. The locking member requires that one end of the strap be guided through the locking member and after the strap is wound around the given object, the strap is pulled through the locking member in the opposite direction and is locked in place. The locking mechanism of this apparatus requires that the strap be pulled in both directions and is a cumbersome design by which the straps can come loose.

3. U.S. Pat. No. 3,292,961 issued to Moberg in 1966 for "Bag Seal" discloses a tie strap for sealing a bag.

4. U.S. Pat. No. 4,543,691 issued to Calmettes in 1985 discloses a hose clamp apparatus.

5. French Pat. No. 1,471,561 issued in 1966 discloses a tieing device where the locking members are protruding projections.

Therefore, while flexible tieing devices have been known in the prior art, none of them combine the creation of a continuous roll of flexible material combined with a specialized interiorly toothed locking mechanism wherein the locking mechanism is a separate piece which can be attached to the strap and the strap needs to pulled through the locking mechanism only once and is secured through a tongue and groove arrangement so as to become irreversible. There is a significant need for such an apparatus in order to enable a user to accommodate any multiplicity of tieing situations of various thickness and radius with a single endless flexible tie strap that can be irreversibly locked around the object to be tied.

SUMMARY OF THE PRESENT INVENTION

The present invention relates to a novel irreversible tie strap in which the tieing strap comes in a roll including an elongated strip member having a multiplicity of holes, grooves or slots therein to accommodate a mating tongue. The strap in roll form can be cut to any desired length, thereby facilitating an efficient strap which can be produced in a single mold and which can be cut to any desired length. Included in the present invention irreversible tie strap is a separate clasp member which can be attached to one end of the the tie strap in a novel manner by which it is permanently affixed and which further can accommodate any desired hole or opening in the strap through an internal tongue which permits the strap to pass through the clasp member until the desired length is achieved and then locked in place by the tongue and groove arrangement.

The present invention consists of supplying a continuous strip of material which may be metallic or thermoplastic, and which includes protrusions, to which a clasp with unidirectional grippers is attached. As a result, only one mold need be produced and the strap can be made in roll length in order to reduce the necessity of production of numerous straps of different lengths. Therefore, waste is considerably reduced.

It has been discovered, according to the present invention, that if a flexible strap member is created in a continuous strip, then any desired length of flexible strap member can be obtained by merely sizing the flexible strap member to fit the object to be tied and then cutting the strap member to length, which length is sufficient to accommodate the closing clasp member.

It has further been discovered, according to the present invention, that if the closing clasp member comprises a pair of flexible gripping members which are spaced adjacent openings in the clasp member and which are further slanted inwardly within the clasp member to permit passage of a strap in one direction only, and the flexible strap member further comprises mating grooves or openings therein, then the clasp member can retain the flexible strap member in an irreversible manner by locking a flexible gripping member into one of the grooves or openings in the flexible strap member adjacent a respective end of the flexible strap member.

It has also been discovered, according to the present invention, that if the flexible clasp member comprises inwardly slanted gripping members with each being in the form of a stem with a pointed end, then the flexible strap member with mating openings can be quickly and efficiently locked in place, without the necessity of running the strap member through the clasp more than once at the same location.

It has additionally been discovered, according to the present invention, that the flexible strap member can also comprise tooth members on its edges in place of the grooves, to be locked into place by the gripping members on the clasp. The tooth members can be symmetrical or asymmetrical along the length of the flexible strap member.

It is therefore an object of the present invention to provide a flexible tie strap which can be used to bundle objects, fasten object together, attach one object to another and perform any multiplicity of fastening and tieing operations wherein the length of the tieing strap can be adjusted to any desired size.

It is a further object of the present invention to provide a flexible tieing strap with a specialized clasp that locks the strap at both ends in an irreversible manner through a simple and effective locking mechanism.

It is another object of the present invention to provide a flexible tieing strap which can be made of thermoplastic material, metal, or any other desired material.

It is an additional object of the present invention to provide a flexible locking strap which can be manufactured in any desired width and thickness in addition to any desired length.

It is also an object of the present invention to provide a flexible locking strap which can be produced in a roll and dispensed from a cartridge or other suitable dispensing apparatus.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of the clasp of the present invention.

FIG. 2 is a perspective view of the present invention irreversible tie strap with both ends of the flexible strap inserted and locked in place in the clasp.

FIG. 3 is a cross-sectional view of the clasp and sections of the flexible strap being locked in place inside the clasp.

FIG. 4 is a perspective view of a multiplicity of clasps mounted on a clasp holding tree and the flexible strap wound within a coil and inserted into a cartridge, with one end of the flexible strap being inserted into a clasp.

FIG. 5 is a perspective view of the flexible strap being wound around an object and cut to size.

FIG. 6 is a perspective view of the cut end of the flexible strap being pulled through the transverse openings in the clasp after the flexible strap has been wound around an object.

DETAILED DESCRIPTION OF THE PREFERRED EMBODIMENT

Figure 7A:
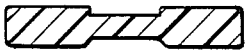
FIG. 7A, 7B, 7C, 7D and 7E are partial perspective views of alternative cross-sections for the flexible strap.
Figure 7B:
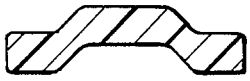
Figure 7C:
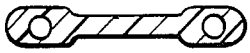
Figure 7D:
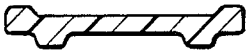
Figure 7E:
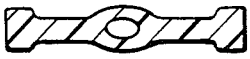

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIGS. 1 and 3, there is shown at 10 the novel clasp member of the present invention. The clasp member 10 is a housing which in the preferred embodiment is generally rectangular in shape. The clasp member 10 has a first sidewall 12, a second sidewall 14, an upper wall 16 and a lower wall 18. A top wall 20 joins all four walls and seals the top end. The bottom 22 is open and leads to an interior chamber 24 which is defined by the first and second sidewalls 12 and 14 respectively, the upper wall 16, the lower wall 18, and the top wall 20. A lower transverse opening 26 extends through lower wall 18 and is located adjacent top 20. An upper transverse opening 28 extends through upper wall 16 and is also located adjacent to top 20 and is further aligned with lower transverse opening 26 such that can an object such as a strap can be passed through the clasp 10 by insertion through lower transverse opening 26, into chamber 24 and through upper transverse opening 28. A first gripping member or tongue 30 is located adjacent the bottom 22 and protrudes from the interior 19 of lower wall 18 into the chamber 24 at an oblique angle relative to lower wall 18. Gripping member 30 includes a base 32 which is attached to the interior surface 19 of bottom wall 18 and a stem portion 34 which terminates in pointed tip 36. While the angle "A" between first gripping member 30 and bottom wall 19 is shown at approximately 30 degrees, it will be appreciated that any angle which is sufficient to permit the strap member (as described later on) to pass between the gripping member and the interior surface 17 of upper wall 16 and then permit the gripping member 30 to lock within a groove or opening (as described later on) of the strap member will be satisfactory. In the preferred embodiment, the first gripping member 30 is formed as an integral part of the clasp 10. Adjacent the top of head 20 of the clasp 10 is a second gripping member 40 which protrudes from the interior 19 of lower wall 18 into the chamber 24 at an oblique angle relative to lower wall 18. Second gripping member 40 includes a base and 42 which is attached to the interior surface 19 of bottom wall 18 and a stem portion 44 which terminates in pointed tip 46. The base 42 is located adjacent the top 20 and on the side of lower transverse opening 26 away from the top 20. While the angle "B" between second gripping member 40 and bottom wall 19 is shown at approximately 45 degrees, it will be appreciated that any angle which is sufficient to permit the strap member (as described later on) to pass through lower transverse opening 26, through chamber 24, and through upper transverse opening 28 and then permit the second gripping member 40 to lock within a groove or opening (as described later on) of the strap member will be satisfactory. In the preferred embodiment, the second gripping member 40 is formed as an integral part of the clasp 10.

Referring particularly to FIG. 2, a second feature of the present invention is a strap 50 which can be made of indeterminate length. The strap or flexible strip 50 can vary in thickness and width. In one preferred embodiment, the flexible strap 50 can be approximately 3/16 inches (or 4.7 millimeters) wide and approximately 0.054 inches (or 1.4 millimeters) thick. Various widths such as ⅛ inch (or 3.2 millimeters), 3/16 inch (or 4.7 millimeters), ¼ inch (or 6.4 millimeters) and 5/16 inch (or 7.3 millimeters) are commercial viable and within the spirit and scope of the present invention. It is emphasized that these dimensions are only representative examples and other widths and thicknesses are certainly within the spirit and scope of the present invention. The flexible strip can be made of any desired material, such as thermoplastic material or from laminated wire or metal. As illustrated in the preferred embodiment of FIG. 2, the strap is rectangular in configuration. Included within the strap are a multiplicity of openings or protrusions which extend along the longitudinal center line of the flexible strap 50 and which are separated by strip material 52, comparable to holes of a belt. In the preferred embodiment, the holes 60 are generally rectangular but other configurations such as circular or oval are within the spirit and scope of the present invention. The holes 60 must be sufficiently large to accommodate the first gripping member 30 and the second gripping member 40.

In use, the end of the flexible strap 50 is first pushed into the clasp 10 through the bottom 22 such that it moves between the tip 36 of first gripping member 30 and the interior surface 17 of upper wall 16. The flexible strap 50 is then moved in the reverse direction until the first gripping member 30 is locked into one of the openings 60 of the flexible strap 50. The first gripping member 30 is flexible so that it can be pushed downward toward lower wall 18 to permit a section of flexible strap 50 to go past it into the chamber 24 and then first gripping member 30 pops upwardly into one of the openings 60 so that its tip 36 and a portion of the stem 34 rests within opening 60. As a result, the loose end or tip of flexible strap 50 is locked within the chamber 24 adjacent the bottom 22 of the clasp 10 and cannot be removed. The strap is then tied around the object to be tied such as a bundle of wires and then cut to the desired length. The now cut or rear end 56 of flexible strap 50 is guided into clasp 10 through lower transverse opening 26, into interior chamber 24 between the interior surface 21 of top 20 and the tip 46 of second gripping member 40 and out through second transverse opening 28. The flexible strap 50 is then moved in the reverse direction until the second gripping member 40 is locked into one of the openings 60 of the flexible strap 50. The second gripping member 40 is flexible so that it can be pushed downward toward the bottom 22 of clasp 10 to permit a section of flexible strap 50 to go past it between interior surface 21 of top 20 and the flexible gripping member 40 and transversely through the chamber 24 and out opening 28 and then second gripping member 40 pops upwardly into one of the openings 60 so that its tip 46 and a portion of the stem 44 rests within opening 60. As a result, the flexible strap 50 is locked within the chamber 24 adjacent the top 20 of the clasp 10 and cannot be removed. The present invention as locked in this fashion is illustrated in FIG. 2.

Referring to FIGS. 4 through 6, in production the clasp 10 can be mounted on a tree 70 such that a multiplicity of clasps 10 protrude from the tree 70 with the bottom 22 extending outwardly to accommodate the loose end of a strap. The flexible strap 50 is wound in a continuous roll 80 of any desired length and the roll 80 is placed in a cartridge so that the front end of the flexible strap 50 protrudes from the cartridge and is ready for mating engagement with a first gripping member 30 adjacent the bottom 22 of a clasp 10. As illustrated in FIG. 4, the cartridge 82 is placed adjacent a clasp 10 on a tree 70 and the flexible strap 50 is inserted into a clasp 50 through its bottom 22 and locked in place inside the clasp 10 by the first gripping member 30 as previously described. The clasp 10 is then snapped off the tree 70 and with the clasp 10 as the leading end, a section of flexible strap 50 is wound around the bundle to be tied, as illustrated in FIG. 5. The bundle 90 to be tied can be anything such as a bundle of wires. After the flexible strap 50 is wound around the bundle 90, an excess length is measured and then cut as also illustrated in FIG. 5. Then the flexible strap 50 is inserted into lower transverse opening 26 and pushed and pulled transversely through interior chamber 24 and then out upper transverse opening 28 and locked in place by second gripping member 40 as previously described. In FIG. 6 a pair of pliers is shown pulling the flexible strap 50 through the clasp 10 but this is optional.

Defined more broadly, the present invention is an apparatus for tieing, comprising: (a) an elongated flexible strap member comprising a multiplicity of openings extending transversely therethrough along its length; (b) a separate clasp member further comprising a housing having a first sidewall, a second sidewall, an upper wall, a lower wall and a top wall thereby defining an interior chamber therein with an opening extending out the bottom of the housing opposite the top wall; (c) said lower wall further comprising a lower transverse opening adjacent said top wall and extending through the lower wall into said interior chamber; (d) said upper wall further comprising an upper transverse opening adjacent said top wall and extending through the upper wall into said interior chamber and aligned with the lower transverse opening in the lower wall; (e) a first gripping member affixed to the interior of said lower wall at a location adjacent the bottom of said housing and extending within said chamber at an oblique angle relative to said lower wall; (f) said first gripping member further comprising an elongated stem ending in a tip which extends into said interior chamber of said housing toward said top wall; (g) a second gripping member affixed to the interior of said lower wall at a location adjacent said top wall and on the side of said lower transverse opening remote from said top wall, and extending within said chamber at an oblique angle relative to said lower wall; and (h) said second gripping member further comprising an elongated end ending in a tip which is located within said chamber between said lower transverse opening and said upper transverse opening; (i) whereby a first end of said elongated flexible strap member can be inserted into the bottom of said clasp such that the tip and a portion of the stem of said first gripping member extend into one of said multiplicity of openings in said elongated flexible strap member adjacent the first end to thereby irreversibly retain the strap member therein and a remote end of said elongated flexible strap member is inserted through said lower transverse opening, through said chamber and out said upper transverse opening such that the tip and a portion of the stem of said second gripping member extend into one of said multiplicity of openings in said elongated flexible strap member adjacent its remote end to thereby irreversibly retain he strap member therein, such that an object can be retained in the length of elongated flexible strap member between the first end and the remote end.

Defined even more broadly, the present invention is an apparatus for tieing, comprising: (a) an elongated flexible strap member comprising a multiplicity of mating members along its length; (b) a separate clasp member further comprising a housing having exterior walls, the housing being open at a first end and having a traverse opening extending laterally through opposing walls of the the housing adjacent its second closed end, and defining an interior chamber within the walls; (c) a first gripping member affixed to the interior of a wall of said housing at a location adjacent the open first end of the housing and extending within said chamber at an oblique angle relative to the wall to which it is attached; (d) said first gripping member further comprising an elongated stem ending in a tip which extends into said interior chamber of said housing toward its closed end; (e) a second gripping member affixed to the interior of a wall of said housing at a location adjacent the closed end of the housing and on the side of said transverse opening remote from said closed end, and extending within said chamber at an oblique angle relative to the wall to which it is attached; and (f) said second gripping member further comprising an elongated end ending in a tip which is located within said chamber between said transverse openings in the walls of the housing; (g) whereby a first end of said elongated flexible strap member can be inserted into the open end of said clasp such that the tip and a portion of the stem of said first gripping member extend into one of said multiplicity of mating members in said elongated flexible strap member adjacent the first end to thereby irreversibly retain the strap member therein and a remote end of said elongated flexible strap member is inserted through said transverse openings in the housing and through the interior chamber such that the tip and a portion of the stem of said second gripping member extend into one of said multiplicity of mating members in said elongated flexible strap member adjacent its remote end to thereby irreversibly retain the strap member therein, such that an object can be retained in the length of elongated flexible strap member between the first end and the remote end.

Therefore, through use of the present invention, a flexible tieing apparatus is achieved by incorporating the concept of an endless flexible strap which can be cut to any desired length combined with a novel clasp member which can be irreversibly locked onto the front and rear ends of the cut flexible strap by a single motion and through a single simple gripping means at each irreversible locking location.

While the present invention irreversible tie strap has been shown in its bundling application, it can also be used to fasten two pieces together in place of screws or rivets. It can also be used as an attaching apparatus such as attaching the identification tag to luggage and other objects.

While the flexible tie strap has been shown in a generally rectangular configuration which is the simplest and preferred embodiment, other configurations are also within the spirit and scope of the present invention. Several possible alternative configurations for the strap are illustrated in FIGS. 7A, B, C, D and E.

Figure 8:
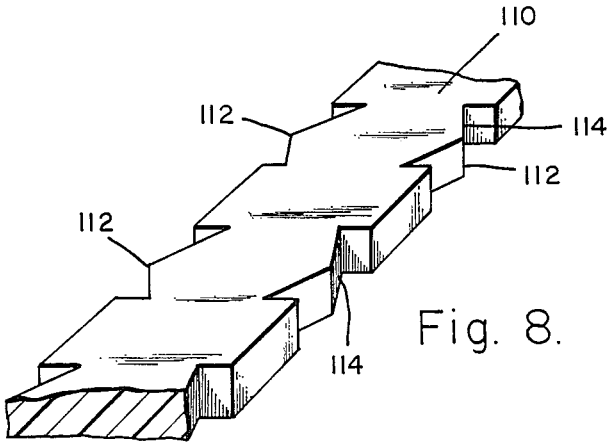
FIG. 8 is a perspective view of an alternative embodiment of the flexible strap with symmetrical toothing on its ends.
Figure 9:
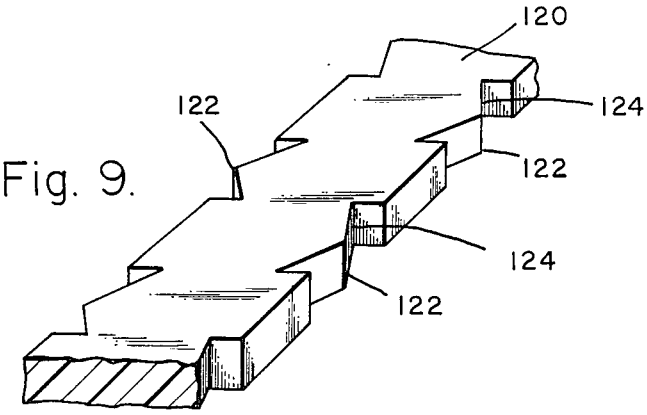
FIG. 9 is a perspective view of an alternative embodiment of the flexible strap with asymmetrical toothing on its ends.

In the preferred embodiment, the flexible strap 50 comprises a multiplicity of holes or openings 60 as previously described. It is also possible for the flexible strap 50 to incorporate toothed arrangements to be locked in place by the first and second gripping members 30 and 40. FIG. 8 discloses a narrow flexible strap 110 which includes a multiplicity of symmetrical tooth arrangements 112 on its exterior surface. The method by which the flexible strap 110 is inserted into the bottom end and the transverse openings of the clasp is the same as previously described. Instead of the first gripping means locking into an opening 60, the tip 36 is locked adjacent the lower cavity 114 of a tooth 112. Similarly, the tip 46 of second gripping means 40 is locked into a lower cavity 114 of a tooth 112 adjacent the cut end of flexible strip 110, as previously described. FIG. 9 discloses a narrow flexible strap 120 which includes a multiplicity of asymmetrical tooth arrangements 122 on its exterior surface. The method by which the flexible strap 120 is inserted into the bottom end of the transverse openings of the clasp is the same as previously described. Instead of the first gripping means locking into an opening 60, the tip 36 is locked adjacent the lower cavity 124 of a tooth 122. Similarly, the tip 46 of second gripping means 40 is locked into a lower cavity 124 of a tooth 122 adjacent the cut end of flexible strip 120, as previously described.

In this embodiment, the present invention can be more broadly defined as an apparatus for tieing, comprising: (a) an elongated flexible strap member comprising a multiplicity of teeth on at least one edge along its length; (b) a separate clasp member further comprising a housing having a first sidewall, a second sidewall, an upper wall, a lower wall and a top wall thereby defining an interior chamber therein with an opening extending out the bottom of the housing opposite the top wall; (c) said lower wall further comprising a lower transverse opening adjacent said top wall and extending through the lower wall into said interior chamber; (d) said upper wall further comprising an upper transverse opening adjacent said top wall and extending through the upper wall into said interior chamber and aligned with the lower transverse opening in the lower wall; (e) a first gripping member affixed to the interior of said lower wall at a location adjacent the bottom of said housing and extending within said chamber at an oblique angle relative to said lower wall; (f) said first gripping member further comprising an elongated stem ending in a tip which extends into said interior chamber of said housing toward said top wall; (g) a second gripping member affixed to the interior of said lower wall at a location adjacent said top wall and on the side of said lower transverse opening remote from said top wall, and extending within said chamber at an oblique angle relative to said lower wall; and (h) said second gripping member further comprising an elongated end ending in a tip which is located within said chamber between said lower transverse opening and said upper transverse opening; (i) whereby a first end of said elongated flexible strap member can be inserted into the bottom of said clasp such that the tip and a portion of the stem of said first gripping member extend into a cavity of one of said multiplicity of teeth in said elongated flexible strap member adjacent the first end to thereby irreversibly retain the strap member therein and a remote end of said elongated flexible strap member is inserted through said lower transverse opening, through said chamber and out said upper transverse opening such that the tip and a portion of the stem of said second gripping member extend into a cavity of one of said multiplicity of teeth in said elongated flexible strap member adjacent its remote end to thereby irreversibly retain the strap member therein, such that an object can be retained in the length of elongated flexible strap member between the first end and the remote end.

In one embodiment, said multiplicity of teeth are located along both edges of said elongated flexible strap and the teeth on both edges are symmetrical. In another embodiment, said multiplicity of teeth are located along both edges of said elongated flexible strap and the teeth on both edges are asymmetrical.

The strap material in any of the embodiments may be any flexible thermoplastic material with good axial resistance. It must be chemically resistant to grease, mineral oils, gasoline and some solvents. For special operations, a metallic belt, extruded or laminated, can be employed.

Through use of the novel clasp 10 of the present invention, the unidirectional grippers (30 and 40) flex momentarily to push the strip in the direction of access, and prevent any counter movement once it latches on the protrusions or openings in the strap. This interaction between grippers and protrusions definitely takes place, and any strain caused by the tieing union makes the unidirectional grippers penetrate the protrusions even more. The grippers may be deflected mechanically before the strap enters in counter direction, that is, to the front, in order to facilitate automation in placing these ties.

The present invention facilitates easy automation of the entire process of production since the flexible strap is continuous and can be cut to any desired rolled lengths and inserted automatically in the dispenser. The flexible strap can also be loaded into a special dispensing gun for deployment and also can be loaded into special automatic assembly machines since the straps can be regulated to any length and the clasp attached. While preferred method of attachment is to attach the clasp to one of end of the flexible strap first as prevously described, for automatic assembly operations, it is certainly within the spirit and scope of the present invention to wind the flexible strap around the object to be tied first and then attach the clasp at the two ends of the strap, as previously described.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for tieing, comprising:

a. an elongated flexible strap member comprising a multiplicity of openings extending transversely therethrough along its length;

b. a separate clasp member further comprising a housing having a first sidewall, a second sidewall, an upper wall, a lower wall and a top wall thereby defining an interior chamber therein with an opening extending out the bottom of the housing opposite the top wall;

c. said lower wall further comprising a lower transverse opening adjacent said top wall and extending through the lower wall into said interior chamber;

d. said upper wall further comprising an upper transverse opening adjacent said top wall and extending through the upper wall into said interior chamber and aligned with the lower transverse opening in the lower wall;

e. a first gripping member affixed to the interior of said lower wall at a location adjacent the bottom of said housing and extending within said chamber at an oblique angle relative to said lower wall;

f. said first gripping member further comprising an elongated stem ending in a tip which extends into said interior chamber of said housing toward said top wall;

g. a second gripping member affixed to the interior of said lower wall at a location adjacent said top wall and on the side of said lower transverse opening remote from said top wall, and extending within said chamber at an oblique angle relative to said lower wall; and h. said second gripping member further comprising an elongated end ending in a tip which is located within said chamber between said lower transverse opening and said upper transverse opening;

i. whereby a first end of said elongated flexible strap member can be inserted into the bottom of said clasp such that the tip and a portion of the stem of said first gripping member extend into one of said multiplicity of openings in said elongated flexible strap member adjacent the first end to thereby irreversibly retain the strap member therein and a remote end of said elongated flexible strap member is inserted through said lower transverse opening, through said chamber and out said upper transverse opening such that the tip and a portion of the stem of said second gripping member extend into one of said multiplicity of openings in said elongated flexible strap member adjacent its remote end to thereby irreversibly retain he strap member therein, such that an object can be retained in the length of elongated flexible strap member between the first end and the remote end.

2. An apparatus in accordance with claim 1 wherein said housing is generally rectangular in configuration.

3. An apparatus in accordance with claim 1 wherein said elongated flexible strap member is wound into a roll.

4. An apparatus in accordance with claim 3 wherein said roll of elongated flexible strap member is inserted into a cartridge dispenser.

5. An apparatus in accordance with claim 1 wherein said elongated flexible strap member is made of thermoplastic material.

6. An apparatus in accordance with claim 1 wherein said clasp is made of thermoplastic material.

7. An apparatus in accordance with claim 1 wherein said clasp is made of metal.

8. An apparatus in accordance with claim 1 wherein said elongated flexible strap member is rectangular in cross-section.

9. An apparatus in accordance with claim 1 wherein each of said multiplicity of transverse openings in said elongated flexible strap member is rectangular.

10. An apparatus in accordance with claim 1 wherein the angle of said first gripping member relative to said lower wall is approximately 30 degrees.

11. An apparatus in accordance with claim 1 wherein the angle of said second gripping member relative to said lower wall is approximately 45 degrees.

12. An apparatus for tieing, comprising:

a. an elongated flexible strap member comprising a multiplicity of teeth on at least one edge along its length;

b. a separate clasp member further comprising a housing having a first sidewall, a second sidewall, an upper wall, a lower wall and a top wall thereby defining an interior chamber therein with an opening extending out the bottom of the housing opposite the top wall;

c. said lower wall further comprising a lower transverse opening adjacent said top wall and extending through the lower wall into said interior chamber;

d. said upper wall further comprising an upper transverse opening adjacent said top wall and extending through the upper wall into said interior chamber and aligned with the lower transverse opening in the lower wall;

e. a first gripping member affixed to the interior of said lower wall at a location adjacent the bottom of said housing and extending within said chamber at an oblique angle relative to said lower wall;

f. said first gripping member further comprising an elongated stem ending in a tip which extends into said interior chamber of said housing toward said top wall;

g. a second gripping member affixed to the interior of said lower wall at a location adjacent said top wall and on the side of said lower transverse opening remote from said top wall, and extending within said chamber at an oblique angle relative to said lower wall; and h. said second gripping member further comprising an elongated end ending in a tip which is located within said chamber between said lower transverse opening and said upper transverse opening;

i. whereby a first end of said elongated flexible strap member can be inserted into the bottom of said clasp such that the tip and a portion of the stem of said first gripping member extend into a cavity of one of said multiplicity of teeth in said elongated flexible strap member adjacent the first end to thereby irreversibly retain the strap member therein and a remote end of said elongated flexible strap member is inserted through said lower transverse opening, through said chamber and out said upper transverse opening such that the tip and a portion of the stem of said second gripping member extend into a cavity of one of said multiplicity of teeth in said elongated flexible strap member adjacent its remote end to thereby irreversibly retain the strap member therein, such that an object can be retained in the length of elongated flexible strap member between the first end and the remote end.

13. An apparatus in accordance with claim 12 wherein said multiplicity of teeth are located along both edges of said elongated flexible strap and the teeth on both edges are symmetrical.

14. An apparatus in accordance with claim 12 wherein said multiplicity of teeth are located along both edges of said elongated flexible strap and the teeth on both edges are asymmetrical.

15. An apparatus in accordance with claim 12 wherein said housing is generally rectangular in configuration.

16. An apparatus in accordance with claim 12 wherein said elongated flexible strap member is wound into a roll.

17. An apparatus in accordance with claim 16 wherein said roll of elongated flexible strap member is inserted into a cartridge dispenser.

18. An apparatus in accordance with claim 12 wherein said elongated flexible strap member is made of thermoplastic material.

19. An apparatus in accordance with claim 12 wherein said clasp is made of thermoplastic material.

20. An apparatus in accordance with claim 12 wherein said clasp is made of metal.

21. An apparatus in accordance with claim 12 wherein said elongated flexible strap member is rectangular in cross-section.

22. An apparatus in accordance with claim 12 wherein each of said multiplicity of transverse openings in said elongated flexible strap member is rectangular.

23. An apparatus in accordance with claim 12 wherein the angle of said first gripping member relative to said lower wall is approximately 30 degrees.

24. An apparatus in accordance with claim 12 wherein the angle of said second gripping member relative to said lower wall is approximately 45 degrees.

25. An apparatus for tieing, comprising:

a. an elongated flexible strap member comprising a multiplicity of mating members along its length;

b. a separate clasp member further comprising a housing having exterior walls, the housing being open at a first end and having a traverse opening extending laterally through opposing walls of the the housing adjacent its second closed end, and defining an interior chamber within the walls;

c. a first gripping member affixed to the interior of a wall of said housing at a location adjacent the open first end of the housing and extending within said chamber at an oblique angle relative to the wall to which it is attached;

d. said first gripping member further comprising an elongated stem ending in a tip which extends into said interior chamber of said housing toward its closed end;

e. a second gripping member affixed to the interior of a wall of said housing at a location adjacent the closed end of the housing and on the side of said transverse opening remote from said closed end, and extending within said chamber at an oblique angle relative to the wall to which it is attached; and f. said second gripping member further comprising an elongated end ending in a tip which is located within said chamber between said transverse openings in the walls of the housing;

g. whereby a first end of said elongated flexible strap member can be inserted into the open end of said clasp such that the tip and a portion of the stem of said first gripping member extend into one of said multiplicity of mating members in said elongated flexible strap member adjacent the first end to thereby irreversibly retain the strap member therein and a remote end of said elongated flexible strap member is inserted through said transverse openings in the housing and through the interior chamber such that the tip and a portion of the stem of said second gripping member extend into one of said multiplicity of mating members in said elongated flexible strap member adjacent its remove end to thereby irreversibly retain the strap member therein, such that an object can be retained in the length of elongated flexible strap member between the first end and the remote end.

* * * * *